US011384768B2

(12) United States Patent
Durand

(10) Patent No.: US 11,384,768 B2
(45) Date of Patent: Jul. 12, 2022

(54) COMPRESSION DEVICE AND METHOD AND REFRIGERATION MACHINE

(71) Applicant: L'Air Liquide, Societe Anonyme pour l'Etude et l'Exploitation des Procedes Georges Claude, Paris (FR)

(72) Inventor: Fabien Durand, Voreppes (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 109 days.

(21) Appl. No.: 16/756,822

(22) PCT Filed: Aug. 1, 2018

(86) PCT No.: PCT/FR2018/051975
§ 371 (c)(1),
(2) Date: Apr. 16, 2020

(87) PCT Pub. No.: WO2019/077212
PCT Pub. Date: Apr. 25, 2019

(65) Prior Publication Data

US 2020/0240437 A1 Jul. 30, 2020

(30) Foreign Application Priority Data

Oct. 16, 2017 (FR) ..... 1701076

(51) Int. Cl.
*F04D 25/16* (2006.01)
*F04D 17/12* (2006.01)
(Continued)

(52) U.S. Cl.
CPC ..... *F04D 25/16* (2013.01); *F04D 17/12* (2013.01); *F04D 29/5806* (2013.01); *F25B 1/10* (2013.01); *F25B 31/006* (2013.01)

(58) Field of Classification Search
CPC ..... F04D 17/12; F04D 17/14; F04D 25/06; F04D 25/16; F04D 29/5806; F25B 31/006; F25B 1/10; F04C 11/001; F04B 25/00
See application file for complete search history.

(56) References Cited

U.S. PATENT DOCUMENTS 5,980,218 A 11/1999 Takahashi et al.
8,899,945 B2 12/2014 Laboube
(Continued)

FOREIGN PATENT DOCUMENTS

CN 104 487 713 4/2015
CN 105 765 234 7/2016
(Continued)

OTHER PUBLICATIONS

International Search Report and Written Report for PCT/FR2018/051975, dated Nov. 12, 2018.
French Search Report for FR 1 701 076, dated Jun. 26, 2018.

*Primary Examiner* — Kenneth J Hansen
(74) *Attorney, Agent, or Firm* — Christopher J. Cronin

(57) ABSTRACT

A device for centrifugal compression of a working gas comprising a plurality of centrifugal compressors forming a plurality of compression stages and a plurality of drive motors for driving the compressors, the device comprising a gas circuit comprising a first pipe for supplying gas to be compressed into the first compressor, the gas circuit comprising a second pipe for discharging the gas compressed therein, the second pipe being connected to an inlet of a second compressor in order to carry out a second compression, the gas circuit comprising a third, cooling, pipe for transferring a fraction of the gas compressed in said compressor into said at least one first motor in order to limit heating thereof, the gas circuit comprising a fourth pipe for recovering the gas that has circulated in the first motor and
(Continued)

a downstream end connected to an inlet of a second motor for transferring the gas into same in order to limit the heating of second motor.

11 Claims, 1 Drawing Sheet

(51) Int. Cl.

| | |
|---|---|
| ***F04D 29/58*** | (2006.01) |
| ***F25B 31/00*** | (2006.01) |
| ***F25B 1/10*** | (2006.01) |

(56) References Cited

U.S. PATENT DOCUMENTS

| | | | | |
|---|---|---|---|---|
| 2012/0100017 | A1* | 4/2012 | La Boube | F04D 25/022 417/321 |
| 2015/0159674 | A1* | 6/2015 | Lee | F04D 17/12 415/66 |
| 2016/0265545 | A1 | 9/2016 | Ueda et al. | |
| 2017/0159665 | A1 | 6/2017 | Bergamini et al. | |

FOREIGN PATENT DOCUMENTS

| | | |
|---|---|---|
| EP | 2 273 130 | 1/2011 |
| JP | H11 294 879 | 10/1999 |

* cited by examiner

COMPRESSION DEVICE AND METHOD AND REFRIGERATION MACHINE

This application is a § 371 of International PCT Application PCT/FR2018/051975, filed Aug. 1, 2018, which claims § 119(a) foreign priority to French patent application FR 1701076, filed Oct. 16, 2017.

BACKGROUND

Field of the Invention

The invention relates to a compression device and method, as well as a refrigeration machine.

More specifically, the invention relates to a centrifugal compression device for a working gas, notably for a refrigeration machine, including several centrifugal compressors forming several successive and/or parallel compression stages and several drive motors for the compressors, the device having a gas circuit comprising a first inlet line for the gas to be compressed that is linked to an inlet of the first compressor to convey the gas to be compressed into the first compressor, the circuit having a second line linked to an outlet of said first compressor to discharge the gas compressed in this latter, the second line being linked to an inlet of a second compressor to convey the gas that has been compressed in the first compressor into the second compressor in order to perform a second compression, the circuit having one third cooling line with one upstream end connected to an outlet of at least one of the compressors and one downstream end connected to an inlet of at least one first motor for transferring a fraction of the gas compressed in said compressor into said at least one first motor in order to limit the heating thereof.

Related Art

A centrifugal compressor using a direct drive between the (electric) motor and the compression wheel or wheels (i.e. with no step-up gear) requires a gas flow to discharge the heat generated in the motor. This heat is generated primarily by the losses from the motor and by friction between the rotor and the gas surrounding same.

This cooling flow is conventionally injected at one side of the motor (at an inlet) and discharged from the other side (at an outlet) at a higher temperature. The cooling flow can also be injected in the middle of the motor and discharged from both sides of the motor.

A greater or lesser part of the heat is also conventionally discharged by a heat-transfer fluid flowing in a circuit surrounding the stator portion of the motor (water or air or any other heat-transfer fluid used to cool the stator).

In order to prevent the loss or contamination of the compressed gas, the gas flowing through the motor to cool the motor usually has the same composition as the compressed gas.

In order to limit the volume of equipment required, the motive force required to cause the gas to flow through the motor or motors is generated by one or more compression stages (i.e. by one or more compressors).

There are several known examples that use this cooling technique.

Document U.S. Pat. No. 6,464,469 describes the use of a portion of the gas leaving the first compression stage to cool the motor. This gas is then returned to the inlet of the compressor.

Document U.S. Pat. No. 5,980,218 describes the use of a portion of the gas leaving the cooling exchanger located downstream of the first compression stage to cool the motor. This gas is then returned to the inlet of the compressor.

Document U.S. Pat. No. 8,899,945 describes an architecture with several motors.

However, these solutions are ill-suited to an architecture with several motors and/or the performance levels are unsatisfactory.

SUMMARY OF THE INVENTION

One objective of this invention is to mitigate some or all of the drawbacks of the prior art as set out above.

For this purpose, the device according to the invention, while corresponding to the general definition given in the preamble above, is essentially characterized in that the circuit includes a fourth line having an upstream end linked to an outlet of the first motor to recover the gas that has flowed through the first motor and a downstream end linked to an inlet of a second motor to transfer the gas there in order to limit the heating of the second motor.

Furthermore, the embodiments of the invention may have one or more of the following features:

- the fourth line includes a gas cooling member to cool the gas between the outlet of the first motor and the inlet of the second motor,
- the circuit includes a fifth line having an upstream end linked to an outlet of the second motor to recover the gas that has flowed through the second motor and a downstream end linked to the inlet of the first compressor in order to compress same,
- the device includes a line-and-valve system designed to distribute the quantities of cooling gas between the first motor and the second motor,
- the fifth line includes a gas cooling member,
- the fourth line has a second downstream end linked to the fifth line, the device including a valve system designed to distribute the gas flow from the first motor between the second motor and the fifth line,
- the second line includes a gas cooling member,
- the gas cooling member of the second line includes a heat exchanger cooled by a heat-transfer fluid,
- the circuit includes a gas cooling member at an outlet of the second compressor,
- the third line includes a valve designed to control the flow rate of the gas transferred to the first motor,
- the device includes at least one motor driving one or more compressors and at least one motor coupled to one or more expansion turbines,
- the device includes one or more rotary joints between the motor or motors and the compressor or compressors or one or several expansion stages such that the pressure in the cavities of the motor or motors is close to the lowest pressure in the compressor, i.e. the inlet pressure of the compressor,
- the compressors are driven in rotation directly by the corresponding motors,
- the device includes several compressors driven by the same motor,
- the device includes one or more expansion stages formed by one or more expansion turbines, preferably centripetal expansion turbines coupled directly to the motor.

The invention also concerns a refrigeration machine for low temperatures between −100° C. and −273° C. including a working circuit containing a working fluid, the working circuit including a centrifugal compression device and a device for cooling and expanding the gas compressed in the compression device, the compression device having any of the features described above or below.

The invention also relates to a centrifugal compression method for a working gas, notably for a refrigeration machine using several centrifugal compressors forming several successive and/or parallel compression stages and several drive motors for the compressors, the compressors being driven in rotation directly by the motors, the method including:

- a compression step for a working gas in a first compressor then in a second compressor arranged in series or in parallel,
- a step for drawing off a fraction of the compressed gas leaving at least one of the compressors and causing this gas drawn off to flow through a first motor in order to cool same, the method including a cooling step for the gas that has been used to cool the first motor followed by a step in which this cooled gas is caused to flow through a second motor in order to cool same.

The invention may also relate to any alternative device or method including any combination of the features set out above or below.

BRIEF DESCRIPTION OF THE FIGURES

Other features and advantages are set out in the description below, provided with reference to the figures in which.

DETAILED DESCRIPTION OF THE INVENTION

Figure 1:
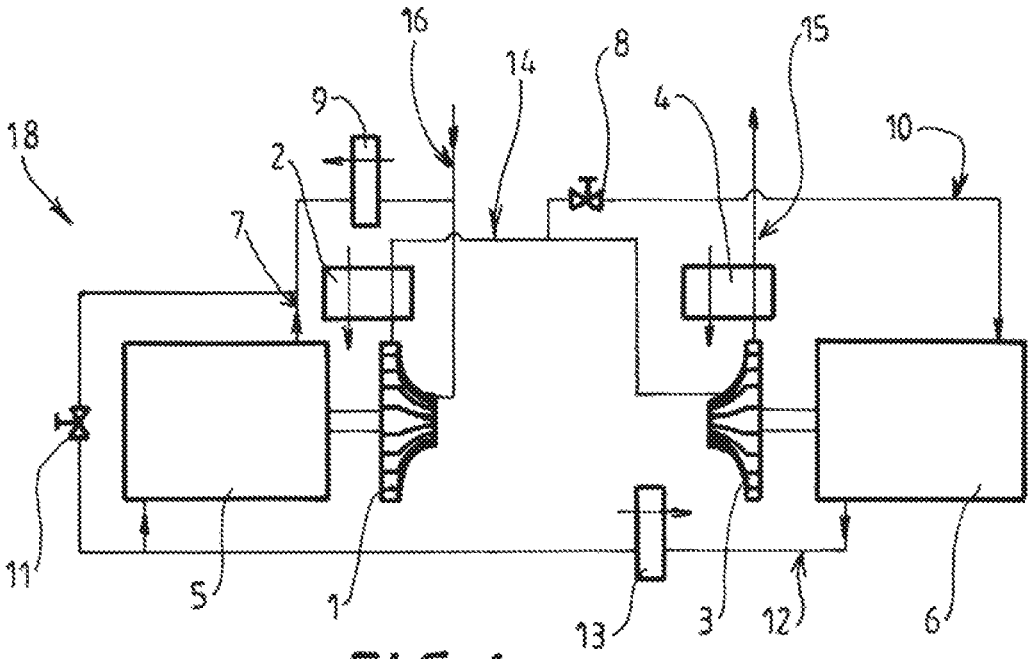
FIG. 1 is a partial schematic view showing an example of the structure and operation of a compression device according to the invention.
Figure 2:
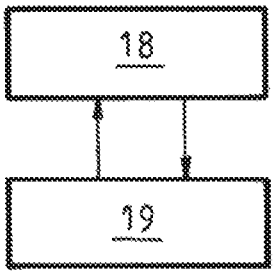
FIG. 2 is a partial schematic view showing an example of the structure and operation of a cooling machine including such a compression device.

The compression device 18 shown schematically in FIG. 1 includes two centrifugal compressors 1, 3 (i.e. two compressor wheels) forming two successive compression stages.

Each of the two compressors 1, 3 is driven by a respective drive motor 5, 6.

Preferably, the compressors 1, 3 are driven in rotation directly by the corresponding motor 5, 6.

The device 18 has a gas circuit comprising a first inlet line 16 for the gas to be compressed that is linked to the inlet of the first compressor 1 to convey the gas to be compressed into the first compressor 1.

The circuit has a second line 14 with an upstream end linked to an outlet of said first compressor 1 to discharge the gas compressed in this latter. The second line 14 has a downstream end that is linked to an inlet of the second compressor 3 to convey the gas compressed in the first compressor 1 into the second compressor 3 in order to perform a second compression (a second compression stage).

The second line 14 preferably includes a gas cooling member 2, for example a heat exchanger cooled by a heat-transfer fluid. This allows the compressed gas to be cooled before said gas enters the second compressor 3.

As illustrated, the circuit preferably includes a gas cooling member 4 at the outlet of the second compressor 3 (for example an exchanger effecting an exchange with a heat-transfer fluid).

The circuit includes a third line 10 having an upstream end connected to the outlet of a compressor 1 and a downstream end connected to a first motor 6 of the two motors.

As illustrated, the upstream end of the third line 10 can be linked to the outlet of the first compressor 1 via the second line 14. In other words, the third line 10 is connected as a bypass to the second line 14 between the first compressor 1 and the second compressor 3.

In other words, the third line 10 draws off a fraction of the compressed gas intended to supply the second compressor 3 to sweep (cool) the first motor. This fraction can be between 1% and 40% of the gas flow coming out of the first compressor 1.

Preferably, the third line 10 can include a valve 8 for controlling the flow rate of the gas transferred to the first motor 6 (or any other suitable member, notably a differential pressure member such as an orifice, turbine, Ranque-Hilsch vortex tube, orifice, capillary, etc.).

The circuit includes a fourth line 12 having an upstream end linked to an outlet of the first motor 6 designed to recover the gas that has flowed through the first motor 6 and a first downstream end linked to an inlet of a second motor 5 designed to transfer the gas there in order to limit the heating of the second motor 5.

In other words, the same cooling gas is used successively to cool the two motors 6, 5.

Preferably, the fourth line 12 includes a gas cooling member 13 to cool the gas between the outlet of the first motor 6 and the inlet of the second motor 5. For example, this cooling member 13 includes a heat exchanger performing a heat exchange with a cooling heat-transfer fluid.

The cooling gas that has flowed through the second motor 5 is discharged via a fifth line 7 having an upstream end linked to an outlet of the second motor 5 (to recover the gas that has flowed through the second motor 5) and a downstream end linked to the inlet of the first compressor 1 in order to compress same. As shown, the fifth line 7 can be linked to the inlet of the first compressor 1 via the first line 16.

The fifth line 7 (and potentially the fourth line 12) can also be used, if necessary, to recover the gas from any leaks (for example in the joints located near to the motors, such as rotary joints for example).

Moreover, the fifth line 7 can include a gas cooling member 9, for example a heat exchanger performing a heat exchange with a cooling heat-transfer fluid.

Also as illustrated, the fourth line 12 can have a second downstream end linked to the fifth line 7 and a valve system 11 designed to distribute the gas flow from the first motor 6 between the second motor 5 and the fifth line 7. In other words, the gas coming out of the first motor 6 (cooling gas) can be distributed between the second motor 5 (in order to cool same) and an inlet of the first compressor 1. This is achieved using two parallel lines and at least one valve 11 (and/or any other differential pressure member: turbine, orifice, etc.). Naturally, the valve 11 (or equivalent) can be arranged at the terminals of the motor 6 (or motors). The valve 11 (or valves) can be a controlled control valve.

Moreover, a by-pass line may be provided for the first motor 6 (for example between the third line 10 and the fourth line) to relatively reduce the quantity of cooling gas in the first motor 6 in relation to the quantity of cooling gas in the second motor 5.

Furthermore, a by-pass line can be provided between the second line 14 (for example after the cooling member 2) and the fourth line (upstream or downstream of the cooling member 13).

Furthermore, a line-and-valve system can be provided to distribute different quantities of cooling gas between the first motor 6 and the second motor 5, as required.

For example, a by-pass valve 11 can advantageously be placed between the inlet and the outlet of the cooling gas of the second motor 5 to limit the flow of cooling gas through this second motor 5 if said flow is too great.

Example Operation with Nitrogen in the Circuit

In the layout in FIG. 1, the mechanical power required to compress for example a flow of 1.26 kg/s of nitrogen gas at an initial pressure of 5 bars absolute and a temperature of 288 K to a pressure of 18.34 bars absolute is 188 kW. This compression power can be split into 88 kW for the motor 5 driving the first compressor 1 and 100 kW for the motor 6 driving the second compressor 3.

This helps to reduce the power compared to the known solutions (typically 6% compared to the prior art).

Indeed, if the two motors 5, 6 are cooled using two different gas flows (two parallel flows drawn from the outlet of a compressor), the quantity of gas drawn off to cool the two motors 5, 6 is twice the quantity used in the architecture described above. This double quantity of gas increases the volume flow of the first compressor 1 and therefore the power required.

According to one embodiment, the nitrogen is compressed for example to 8.87 bars absolute in the first centrifugal compression stage 1 with a power of 83 kW and a typical isentropic efficiency of 86%. This compressed gas is then cooled in the heat exchanger 2.

A portion of the gas is drawn off via the valve 8 to cool the first motors 6. The remainder (the main flow) is then compressed again to 18.34 bars absolute in the second compression stage 3. This second compressor 3 for example has a power of 95 kW and a typical isentropic efficiency of 86%. The gas is then cooled in the heat exchanger 4 at the outlet of the second compressor 3. The gas is then conveyed to the outlet 15 of the device 18.

Of the 88 kW and 100 kW of power supplied by the motors 5, 6, typically 5% is transformed into heat (losses from the electric motor and losses through friction of the rotor with the nitrogen), i.e. approximately 5 kW per motor.

A portion of the nitrogen flow at the outlet of the exchanger 2 is then conveyed through the valve 8 and the third line 10 to supply the first motor 6 with cooling gas.

The temperature increase in the gas through the first motor 6 is typically limited to 30 K (to limit the heating of the motor) by controlling the valve 8. This results in a mass flow=Power/Cp/deltaT=5000/1048/30=0.159 kg/s.

Where Power=the thermal losses from the motor to be discharged by the gas in W.

Cp=the thermal capacity of the gas (nitrogen in this example) in J/kg/K.

Delta T=the temperature increase in the gas between the lines 10 and 12 in K (between the inlet and the outlet of the motor 6).

The nitrogen is then discharged from the first motor 6 via the fourth line 12 and returns to the exchanger 13 to be cooled to a temperature preferably equal or close to the entry temperature of the first compressor 1.

This cooling is effected before the gas enters the second motor 5.

The temperature increase in the gas through the second motor 5 is preferably of the same order of magnitude as the increase through the first motor 6 (the flow rate and the pressure to be extracted are preferably similar).

Having passed through the second motor 5, the cooling gas is conveyed to the heat exchanger 9 downstream via the fifth line 7 to be cooled before returning to the inlet 16 of the first compressor 1.

Thus, compared to a solution in which the two motors 5, 6 are cooled in parallel (via two distinct cooling gas flows coming from a compressor), the solution according to the invention uses a single gas flow that is conveyed to cool two motors (in series on the cooling gas circuit). This makes it possible to split the necessary cooling gas flow into two.

Thus, while being a simple and cheap structure, the invention enables the (thermally and energetically) efficient cooling of a plurality of motors of a compression device.

Naturally, the invention is not limited to the sample embodiment described above.

Thus, the gas used to cool the motors can be drawn from the outlet of another or several other compressors, other than the first compression stage. Furthermore, the device can include more than two compressors and more than two motors. Furthermore, the expansion turbines can be included in the device.

Furthermore, several compression stages can be driven by a single motor.

Furthermore, one or more expansion stages (turbines, preferably centripetal turbines) can be mounted on the same drive shaft as one or more compressors.

Furthermore, some or all of the cooling members 9, 13 can be omitted (the use thereof helps to improve the efficiency of the system, but these latter are not necessary).

The valve or valves 8, 11 can advantageously be adjustable for example as a function of the temperature of one or more motors and/or the cooling flow and/or the temperature of the cooling gas.

Furthermore, these expansion members 8, 11 can, where necessary, cool the gas before the gas enters the motor or motors. Furthermore, these expansion members 8, 11 can be replaced (or substituted) by any other differential pressure member, such as an orifice, turbine or capillary, for example. Thus, the valves 8, 11 can be replaced by or associated with a turbine or turbines and/or Ranque-Hilsch vortex tubes. Furthermore, the member 8 can be positioned alternatively on the second line 14, for example. Furthermore, the member 11 can be positioned alternatively on the first line 16, for example.

Furthermore, rotary joints can be used between the motor or motors 5, 6 and the compression stage or stages 1, 3 or the expansion stage or stages such that the pressure in the cavities of the motor is close to the lowest pressure in the compressor, i.e. the inlet pressure 13 of the compressor. This reduces the losses through friction between the rotor or rotors and the gas since these losses are proportional to the pressure in the cavity of the motor. The leaks recovered from this joint or these joints are added to the cooling gas flow coming from the third line.

As shown in FIG. 3, the compression device 18 can be part of a refrigeration machine for low temperatures, for example between −100° C. and −273° C., and including a working circuit 10 containing a working fluid, the working circuit including a centrifugal compression device 18 and a device 19 for cooling and expanding the gas compressed in the compression device 18.

The working gas can be made up in full or in part of nitrogen, helium, hydrogen, neon, argon, carbon monoxide, methane, krypton, xenon, ethane, carbon dioxide, propane, butane and oxygen.

According to other possible features:

a line fitted with a valve system linking the second line 14 and the fourth line 12 can be provided, the cooling member 2 can be designed to cool the gas to a lower temperature, for example 0° C. to improve cooling of the motor, the cooling member 2 can if necessary be arranged on the third line 10 (instead of or in addition to the second line 14), the direction of flow of the cooling gas can be inverted (to the second motor 5 first and then to the first motor 6), the device can have more than two motors cooled in this manner, the device can include several compressors mounted on a motor or one or more expansion stages on this motor or on another motor.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing i.e. anything else may be additionally included and remain within the scope of "comprising." "Comprising" is defined herein as necessarily encompassing the more limited transitional terms "consisting essentially of" and "consisting of"; "comprising" may therefore be replaced by "consisting essentially of" or "consisting of" and remain within the expressly defined scope of "comprising".

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

What is claimed is:

1. A centrifugal compression device for compression of a working gas for a refrigeration machine, comprising:

a plurality of centrifugal compressors comprising first and second centrifugal compressors;

a plurality of associated drive motors for the plurality of centrifugal compressors, said plurality of drive motors comprising first and second drive motors; and a gas circuit comprising a first inlet line for the working gas linked to an inlet of the first compressor for conveying the working gas into the first centrifugal compressor, a second line linked to an outlet of the first centrifugal compressor and an inlet of the second centrifugal compressor for discharging the working gas from the first compressor and into the second centrifugal compressor, a third line being a cooling line and having an upstream end connected to an outlet of at least one of the plurality of centrifugal compressors and a downstream end connected to an inlet of at least the first drive motor for transferring a fraction of the working gas compressed from said at least one of the plurality of centrifugal compressors to the first drive motor in order to limit heating of the first drive motor, and a fourth line having an upstream end linked to an outlet of the first drive motor and at least one downstream end, the at least one downstream end of the fourth line comprising a first downstream end that is linked to an inlet of a second drive motor and being designed to recover the working gas that has flowed through the first drive motor and transfer, to the second drive motor in order to limit the heating of the second drive motor, the working gas recovered from the first drive motor, wherein the fourth line includes a first gas cooling member to cool the working gas between the outlet of the first drive motor and the inlet of the second drive motor.

2. The device of claim 1, wherein:

the gas circuit further comprises a fifth line having an upstream end linked to an outlet of the second drive motor and at least one downstream end comprising a first downstream end; and the first downstream end of the fifth line is linked to the inlet of the first centrifugal compressor and is designed to recover the working gas that has flowed through the second drive motor in order to compress the working gas recovered from the second drive motor.

3. The device of claim 2, wherein the fifth line includes a second gas cooling member.

4. The device of claim 2, wherein the at least one downstream end of the fourth line further comprises a second downstream end that is linked to the fifth line.

5. The device of claim 1, further comprising a line-and-valve system designed to distribute quantities of cooling gas between the first drive motor and the second drive motor.

6. The device of claim 1, wherein the second line further comprises a third gas cooling member.

7. The device of claim 6, wherein the third cooling member of the second line comprises a heat exchanger cooled by a heat-transfer fluid.

8. The device of claim 1, wherein the first gas cooling member is disposed at an outlet of the second centrifugal compressor.

9. The device of claim 1, wherein the third line further comprises a valve designed to control a flow rate of the working gas transferred to the first drive motor.

10. A refrigeration machine for low temperatures between −100° C. and −273° C. including a working circuit containing a working fluid, the working circuit including the centrifugal compression device of claim 1 and a device for cooling and expanding the gas compressed in the centrifugal compression device.

11. A centrifugal compression method for a working gas for a refrigeration machine using a plurality of centrifugal compressors and a plurality of drive motors for the compressors, each of the plurality of compressors being driven in rotation directly by an associated one of the drive motors, the plurality of centrifugal compressors comprising first and second centrifugal compressors, the plurality of drive motors comprising first and second drive motors, said method comprising the steps of:

sequentially compressing the working gas in a the first centrifugal compressor and then in the second centrifugal compressor;

drawing off a fraction of the working gas from at least one of the first and second centrifugal compressors; and causing the drawn off working gas to flow through the first drive motor in order to cool the first drive motor, wherein the working gas that has flowed through the first drive motor is cooled and conveyed to the second drive motor in order to cool the second drive motor.

* * * * *